United States Patent [19]

Aston et al.

[11] Patent Number: 4,866,962

[45] Date of Patent: Sep. 19, 1989

[54] ELECTRONIC KEY-OPERABLE LOCK AND KEY THEREOF

[75] Inventors: Walter J. Aston, Dudley; Paul Garbett, Wolverhampton, both of England

[73] Assignee: Yale Security Products Limited, Willenhall, England

[21] Appl. No.: 197,257

[22] Filed: May 23, 1988

[30] Foreign Application Priority Data

May 23, 1987 [GB] United Kingdom ..... 8712258
Aug. 7, 1987 [GB] United Kingdom ..... 8718731

[51] Int. Cl.[4] ..... E05B 47/00

[52] U.S. Cl. ..... 70/277; 70/278; 70/409

[58] Field of Search ..... 70/277, 278, 276, 279–283, 70/409, 406, 405, 413

[56] References Cited

U.S. PATENT DOCUMENTS 4,712,398 12/1987 Clarkson ..... 70/278

FOREIGN PATENT DOCUMENTS 2809351 11/1978 Fed. Rep. of Germany ..... 70/409
2856008 6/1980 Fed. Rep. of Germany ..... 70/406
2500520 8/1982 France ..... 70/409
596706 3/1978 U.S.S.R. ..... 70/406

*Primary Examiner*—7
*Assistant Examiner*—Robert L. Wolfe
*Attorney, Agent, or Firm*—Fleit, Jacobson, Cohn, Price, Holman & Stern

[57] ABSTRACT

A key for an electronic lock is provided with a relief coding for reading by a mechanically actuated reading device. The key has a blade along a narrow edge face of which there are formed grooves (or pairs of notches) extending either perpendicularly to the length of the blade or inclined to the perpendicular in one sense or the other.

A lock is described in which the grooves or notches are read by two separate reading elements and an electronic circuit determines the key coding by detecting whether the reading elements detect the grooves or notches at the same time or in one order or the other.

13 Claims, 7 Drawing Sheets

ELECTRONIC KEY-OPERABLE LOCK AND KEY THEREOF

This invention relates to an electronic key-operable lock for use, inter alia, on a door, and a key therefor Conventional locks make use of keys which can readily be produced in. quantity A typical key has a grip portion and an elongated blade, the cross-section of which is shaped to match a complementary broached keyway in the barrel of a coacting lock. One edge of the blade has an edge profile which coacts with a conventional pin-tumbler arrangement in the barrel in well known manner.

Conventional keys of this type have been in use for many years and many systems of multi-level master keying have been developed which rely on the many possible variations of blade cross-section and edge profile. Extremely sophisticated master keying systems which operate entirely mechanically now exist.

There is, however, a demand for electronic access control systems and there is frequently a need to provide, in a conventional master-keyed system, a number of locks which are electronically operated and can record details of their usage. For example, it is often desirable to record the time and date of each access as well as an identification number of the key used. Each key is, of course, already identifiable by reference to its cross-sectional shape and edge profile, but the number of sensors which would be required in the electronic lock to sense all this information could not be fitted into a sensibly sized lock.

There have already been various proposals for reading coding marks (or the like) on a key by means of sensor devices built into the lock These tend, however, to be bulky, and therefore the number of code tracks which can be read is limited Hence the number of different codes which can be recognised is likewise limited It is therefore one object of the present invention to provide a key for an electronic lock which is capable of carrying a large amount of code data in a simple form.

In accordance with one aspect of the invention there is provided a key for operating an electronically operable lock, said key having a grip portion and a blade portion of a cross-section suitable for reception by the key slot of a conventional mechanical cylinder lock, said blade portion being notched along one edge for operation of a conventional cylinder lock, the opposite edge face of said blade being formed with a relief code pattern comprising a plurality of code elements spaced along the blade, each code element comprising two mechanically readable code portions spaced apart across the width of said other edge of the blade and located relative to one another in one of three possible positions, namely directly opposite one another or spaced longitudinally along the blade in one direction or the other.

With such a key a simple key reading device can be incorporated in the lock which includes two mechanical/electrical transducers which read along two tracks spaced across the width of said other edge of the key and respectively sense the two code portions of each code element. As each code element consists of two code portions, there will always be a code portion on one track corresponding to each code portion on the other track and it is only necessary for the electronic circuitry associated with the transducers to determine whether the signals generated by the two code portions of each code element arrive substantially simultaneously or, if not, which signal occurs first.

In this way, it is a relatively simple matter to overcome problems associated with previously proposed key readers arising from variations in the speed of insertion of the key. One conventional arrangement for overcoming these problems has been to employ two reading devices which read a code track having regularly spaced readable formations and a code track having readable formations which are present only at selected ones of a plurality of positions. This prior construction produced a binary code, whereas the key defined above is actually arranged to produce a ternary code (since there are three possible "values" of each code element). Moreover no clock track is required.

Thus a very large number of difference codes can be detected for a given number of code elements. For a key with 12 code elements, for example, the prior construction could provide only 4096 different codes (i.e. $2^{12}$), whereas, with the same number of reading devices, the construction according to the present invention can provide $3^{12}$ or 531,441 different codes, representing an improvement by a factor of more than 100.

The code elements may consist of grooves extending across the edge face of the blade, either perpendicularly to the length of the blade, or inclined to the perpendicular in one direction or the other.

Alternatively the code elements may each consist of a pair of notches cut in such edge face at the positions where the grooves as mentioned above would end.

It is another object of the invention to provide an electronic lock for use with a key as defined above.

An electronic lock in accordance with the invention comprises a body, a cylinder rotatably mounted in a bore in the body, said cylinder being formed with a key slot for receiving the key, a pair of mechanically operable reading devices having probes projecting into the key slot so as to be actuable by the code elements on said key as the key is inserted into the key slot, circuit means for determining whether actuation of one of the reading devices by one code portion of each code element occurs before, simultaneously with or after actuation of the other reading device by the other code portion of the same code element and electromechanical means operable by said circuit means on recognition of an acceptable key coding to permit opening of the lock by turning of said cylinder.

The invention also resides in the combination of a lock and key both as defined above.

Figure 1:
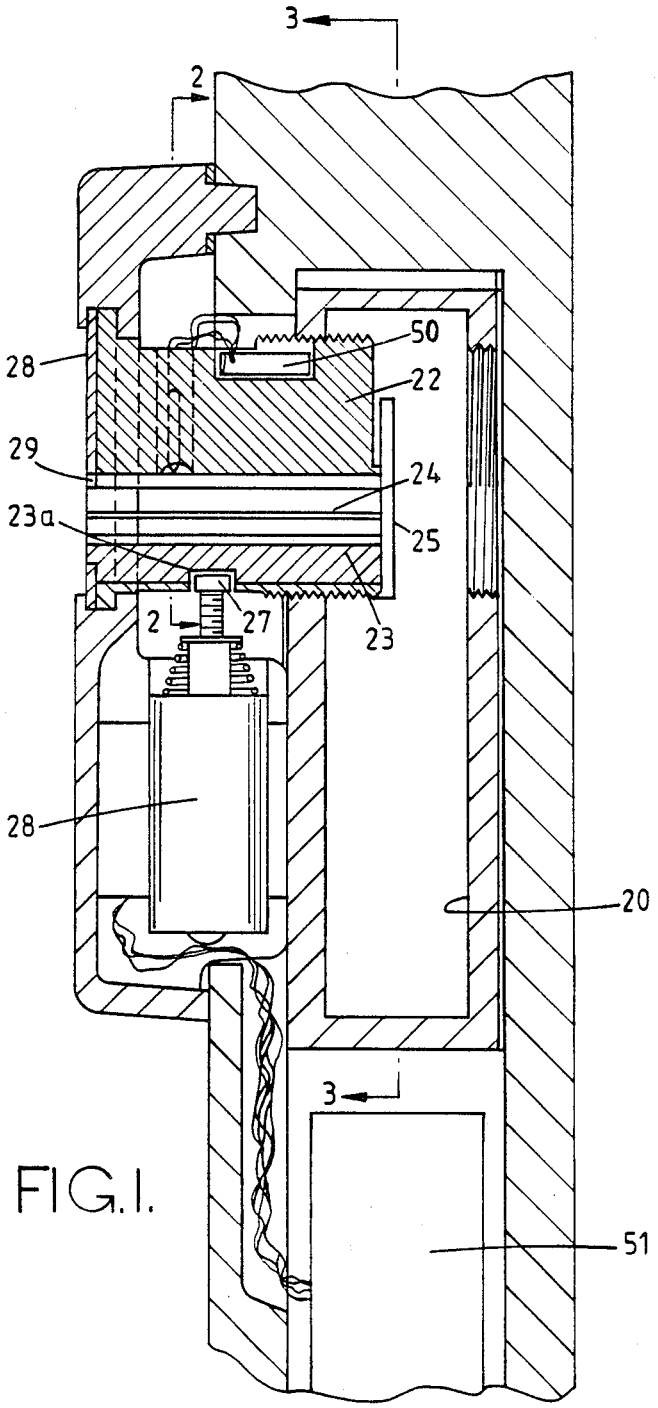
FIG. 1 is a section through one example of a lock in accordance with the invention.
Figure 2:
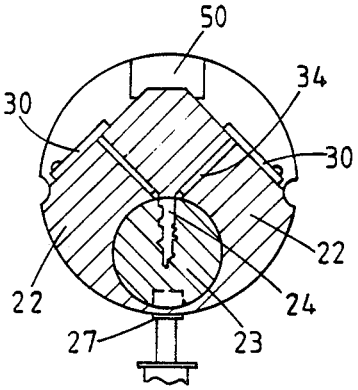
FIG. 2 is a fragmentary section on line 2—2 in FIG. 1.
Figure 5:
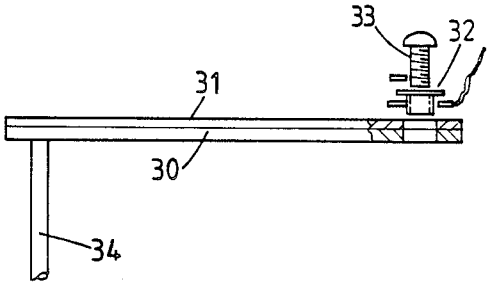
FIG. 5 is an enlarged view of a reading device forming part of the lock.
Figure 4:
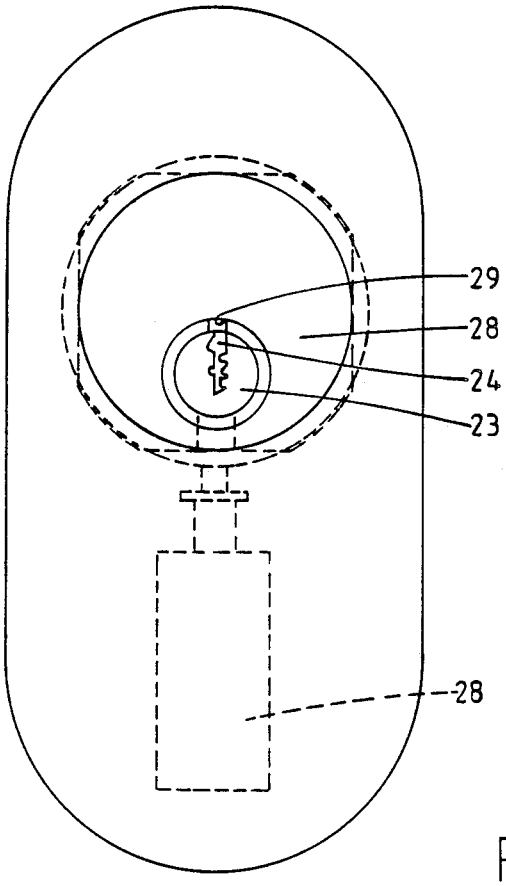
FIG. 4 is an elevation of an escutcheon forming a part of the lock.
Figure 3:
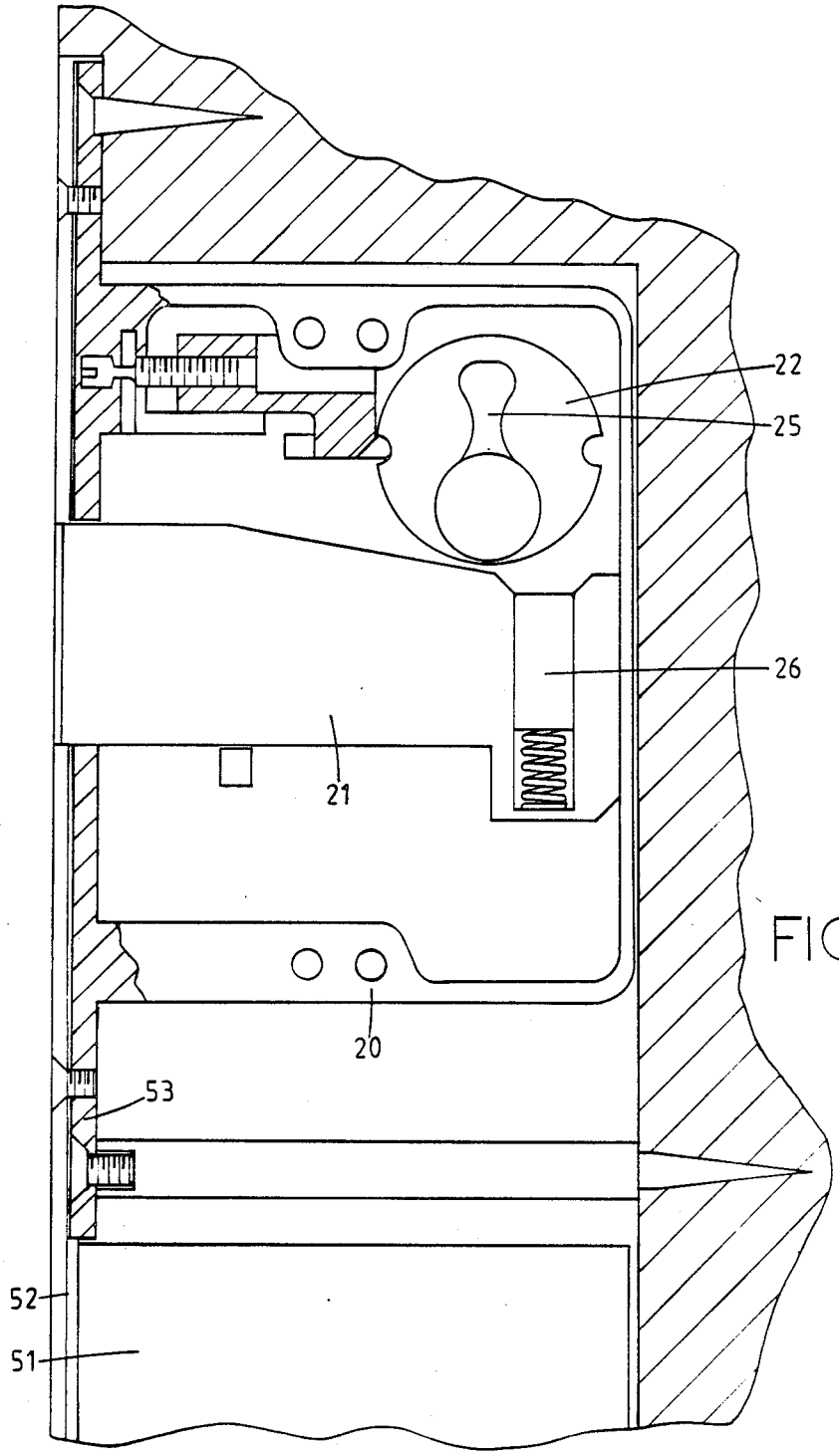
FIG. 3 is a section on line 3—3 in FIG. 1.

Referring firstly to FIGS. 1 to 5, the lock shown includes a lock casing 20, in which a bolt 21 is slidably mounted (not shown in FIG. 1). Attached to the casing is a cylinder body 22 in a bore in which a cylinder 23 is rotatably mounted. The cylinder 23 is formed with a key slot 24 having a complex cross-sectional shape as is well known in conventional mechanically operated cylinder locks. A cam 25 is secured to one end of the cylinder inside the casing 20 and coacts with the bolt 21 to release a spring-loaded catch device 26 mounted on the bolt and displace the bolt between projecting and withdrawn (shown) positions. The catch device 26 operates in well-known manner to retain the bolt in these two positions The cylinder 23 is retained in the position shown by a plunger 27 of a solenoid device 28 The body 22 has a hole through which the end of this plunger 27 extends into a recess 23a in the cylinder On energisation of the solenoid, the cylinder can be turned by the key so that the bolt 21 is driven in or out (according to the direction of turning) by the cam 25. A front plate 28 fixed to the body 22 has a circular hole through which a reduced diameter end portion of the cylinder 23 extends. A notch 29 in the plate 28 is aligned with the key slot in the cylinder only when the latter is in the position shown. This is used to ensure that the key (to be described hereinafter) can only be withdrawn when the cylinder is in this position. Thus, on locking or unlocking the cylinder must be turned through 360°, i.e. back to the same position As can be seen from FIG. 2, the key slot actually opens on to the surface of the cylinder and this permits access to a relief code on the key, by two reading devices mounted on the body 22. Each reading device comprises a spring metal strip 30 on which there is mounted a layer of piezo-electric plastics film 31. A suitable film is supplied by Pennwalt Corporation (U.S.A.) under the brand name KYNAR The film 31 is preferably of a thickness of 28 μm and is coated on each face with an electrically conductive layer of layers, such as a 150 Å thick layer of nickel covered by a 400 Å thick layer of aluminium. The film 31 is bonded to the base strip 30 so as to provide an electrical connection between the base strip 30 and the adjacent conductive layer. The strip 30 is mounted on a flat on the body 22 by means of an insulating bush 32 inserted into a hole at one end of the strip and a screw 33 inserted through this bush and engaged in a tapped bore in the body. An electrical connection to the other conductive layer is made by means of a connector trapped between the bush 32 and the film 31.

Adjacent the opposite end of the strip 30, there is an elongated probe 34 attached to the strip, which extends through a bore in the body 22. As shown, the two probes 34 project into the key slot 24 at opposite sides of the width thereof, and are arranged in a V-formation.

Figure 6:
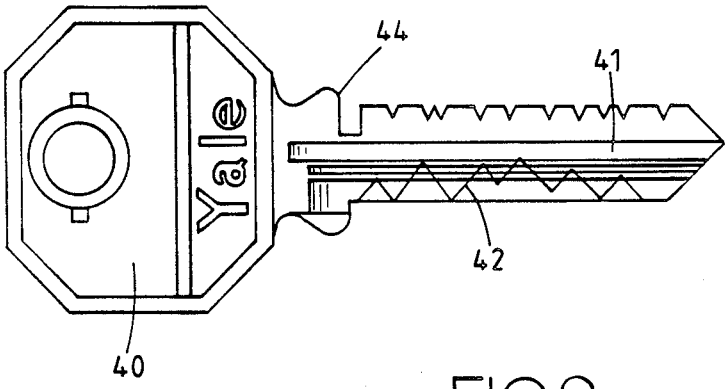
FIG. 6 is an elevation of an example of a key in accordance with the invention.
Figure 7:
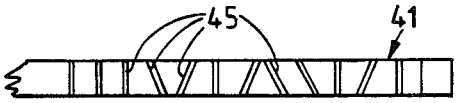
FIG. 7 is a fragmentary plan view of the key of FIG. 6, showing code elements on an edge face of the key blade.

The key shown in FIGS. 6 and 7 is generally speaking of conventional configuration having a grip portion 40 and an elongated blade 41 which has a cross-section complementary to that of the key slot so that it can be received snugly thereby. The blade has one edge formed with notches (shown diagrammatically by line 42) which enable it to be used to actuate conventional mechanical cylinder locks.

To enable it to be used with an electronic lock, however, the opposite edge of the blade, which is normally a narrow flat edge face, is formed with a relief coding which can be read by the reading devices mounted on the cylinder body. In the example shown in FIGS. 6 and 7 the relief coding consists of a plurality of code elements spaced along the blade. Each code element is a groove 45 extending across the edge face, either perpendicularly to the length of the blade or inclined one way or the other to a perpendicular. In the example shown there are ten such grooves, although it is to be understood that any convenient number may be employed.

Figure 8:
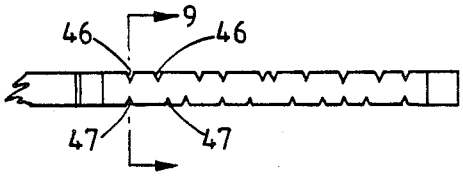
FIG. 8 is another view like FIG. 7, but showing a modified form of code element.
Figure 9:
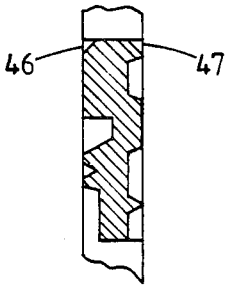
FIG. 9 is an enlarged section on line 9—9 in FIG. 8.

For coacting with the front plate 28 there is a rectangular notch 43 in the blade 41 immediately adjacent the stop 44 which limits key insertion. The key can be inserted only when the cylinder 23 is in the home position shown in FIG. 4 and can be turned only when fully inserted (assuming the solenoid 28 to be energised). The notch 43 embraces the edge of the hole in the plate 28 and prevents withdrawal of the key when the cylinder is turned out of its home position The modified key shown in FIGS. 8 and 9 has instead of the grooves 45 a pair of notches 46, 47 at the positions where the grooves 45 would have run out at the extreme edges of the edge face. These notches can be formed by relatively simple tooling in which a cutter head is stepped along the blade and, at each code element position turned to the appropriate angle before being fed towards the blade to form both notches 26, 27 simultaneously.

Figure 10:
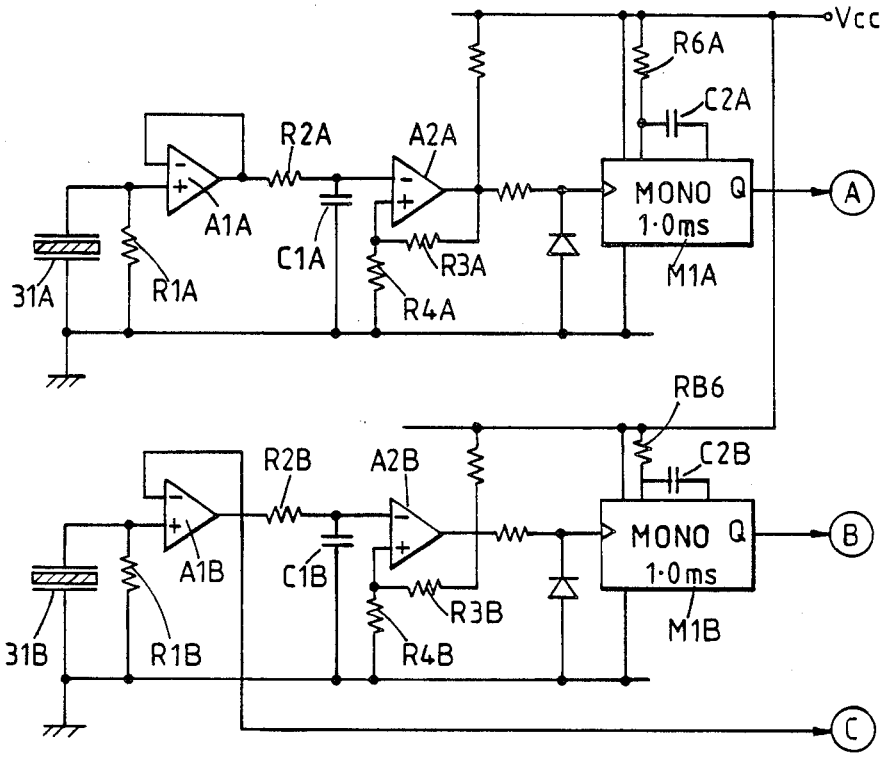
FIG. 10 is the electrical circuit diagram showing a buffer circuit forming a part of the lock.

The electronic circuitry of the lock is divided into two parts, one of which is in the form of a small, encapsulated package 50 located in a recess in the cylinder body as close as possible to the reading devices. This package contains a buffer circuit which is shown in FIG. 10. The piezo-electric film elements 3lA, 3lB each have one terminal grounded and the other terminal connected by a very short lead to the non-inverting input of an operational amplifier $A1_A$, $A1_B$. Each such amplifier is connected as a high input impedance voltage follower, there being a direct feedback connection from the output terminal of each amplifier to its inverting input terminal. A resistor $R1_A$, $R1_B$ connects the inverting input of each amplifier to ground.

In the remaining description of FIG. 10 only one channel is described, namely that associated with element 31A. The other channel is identical, the corresponding parts being indicated in FIG. 10 by reference numerals with subscript B instead of A.

The output terminal of amplifier A1A is connected by a resistor $R2_A$ to the inverting in of a voltage comparator $A2_A$. A capacitor $Cl_A$ this inverting input to ground The comparator $A2_A$ is connected as a Schmitt trigger circuit, having a pair of resistors $R3_A$ and $R4_A$ connected in series between its output terminal and ground and the common point of these resistors connected to the non-inverting input of the comparator. The output terminal of the comparator is connected by a resistor $R5_A$ to the input terminal of a monostable circuit $M1_A$ having timing components $R6_A$ and $C2_A$ chosen to provide a reversion time of about lmS. A diode $D1_A$ has its cathode connected to the input terminal of the monostable circuit $M1_A$ and its anode grounded.

The film elements 31A, 31B are arranged to provide an increasing positive voltage as the strips on which they are mounted are bent away from the key. As the Schmitt trigger circuits are connected to operate in inverting mode this means that each monostable circuit $M1_A$, $M1_B$ is triggered as the corresponding probe element drops into a groove or notch in the key blade edge. The monostable circuits $M1_A$, $M1_B$ are non-retriggerable so that a single lmS pulse is produced commencing as the probe drops into the groove or notch. Any "bounce" effects are ignored.

Figure 11:
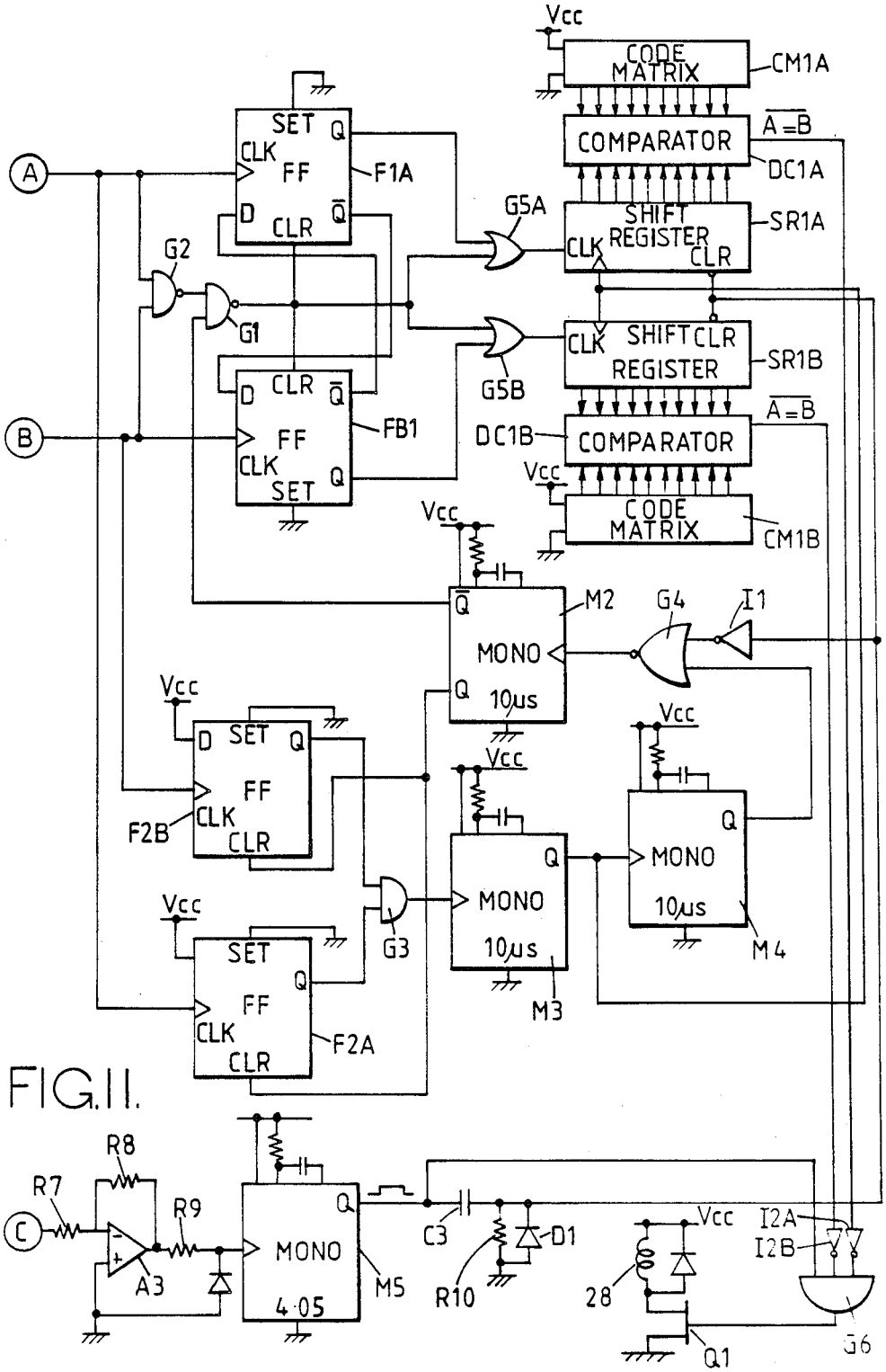
FIG. 11 is the electrical circuit diagram (partly schematic) of a key recognition and control circuit forming part of the lock.

Turning now to FIG. 11, the output terminals of the two monostable circuits $M1_A$ and $M1_B$ are connected respectively to the CLOCK input terminals of two D-type flip-flop circuits $F1_A$, $F1_B$. The $\overline{Q}$ output of each of these circuits is connected to the D input of the other one. The SET inputs of both flip-flop circuits are grounded and the CLEAR inputs are connected to the output of a NAND gate $G_1$. This NAND gate $G_1$ has one input from the $\overline{Q}$ output of a monostable circuit $M_2$ and another input from the output of a NAND gate $G_2$, the two inputs of which are connected to the outputs of the two monostable circuits $M1_A$, $M1_B$.

The outputs of the two monostable circuits $M1_A$ and $M1_B$ are also connected to the CLOCK inputs of two further D-type flip-flop circuits $F2_A$, $F2_B$, the SET terminals of which are grounded and the D terminals of which are connected to the positive supply rail. The Q output terminals of the circuits $F2_A$, $F2_B$ are connected to the input terminals of an AND gate $G_3$, the output of which is connected to the input terminal of a monostable circuit $M_3$, set up to give a 10 $\mu$S pulse. This monostable circuit has its Q output connected to the input of another monostable circuit $M_4$, again having a 10 $\mu$S reversion time.

An output from amplifier $A1_B$ in FIG. 10 is connected by a resistor $R_7$ to the inverting input of an operational amplifier $A_3$ which has a feedback resistor $R_8$ and operates as an inverting amplifier with a gain of about 50. A resistor $R_9$ connects the output of amplifier $A_3$ to the input of a monostable circuit $M_5$ which is set up to give a pulse length of 4 seconds. The output of this monostable circuit is connected by a capacitor $C_3$ to the cathode of a diode $D_1$ the anode of which is grounded. A resistor $R_{10}$ is connected in parallel with the diode $D_1$. The cathode of diode $D_1$ is connected to the input of a logic inverter $I_1$ the output of which is connected to one input of a NOR gate $G_4$. The other input of gate $G_4$ is connected to the Q output of the monostable circuit $M_4$ and the output of gate $G_4$ *is connected to the input of the monostable circuit* $M_2$. The Q output of circuit $M_2$ is connected to the CLEAR input terminals of flip-flop circuits $F2_A$ and $F2_B$.

The Q outputs of circuits $F1_A$ and $F1_B$ are connected respectively to the inputs of two OR gates $G5_A$ and $G5_B$ which have their other inputs connected to the output of the gate $G_1$. The outputs of the gates $G5_A$, $G5_B$ are connected respectively to the DATA inputs of two serial-in parallel-out shift registers $SR1_A$ and $SR1_B$. The CLOCK input terminals of these two shift registers are connected to the Q output terminal of monostable circuit $M_3$ and their CLEAR input terminals are connected to the cathode of the diode $D_1$. The parallel data output terminals of each shift register are connected to respective input terminals of two digital comparators $DC1_A$ and $DC1_B$. The other set of inputs of each of these comparators is connected to an associated code matrix $CM1_A$, $CM1_B$ which may be in the form of an array of switches or links determining whether each input of said other set of inputs is set high or low.

The $\overline{A}2$ B outputs of the comparators $DC1_A$, $DC1_B$ are connected to two logical inverters $12_A$, $12_B$, the outputs of which are connected to two inputs of an AND gate $G_6$. Gate $G_6$ is connected to drive a power f.e.t. $Q_1$ which controls the current in the solenoid 28. When a key is inserted into the keyslot the first signal from the piezo-electric element $31_B$ will trigger monostable circuit $M_5$. The four second output pulse from this enables gate $G_6$ for 4 seconds in case the correct code combination is subsequently received as the key is read. The start of the four second pulse also clears the two shift registers and also clears all four flip-flop circuits via monostable circuit $M_2$.

If the lmS pulses from both monostable circuits $M1^A$ and $M2_A$ overlap (indicating that the groove being read is perpendicular to the length of the blade) this is detected by gate $G_2$ which clears both flip-flop circuits via gate $G_1$. This will mean that both of gates $G5_A$ and $G5_B$ will output high level signals. If, on the other hand, there is no overlap, the output of gate $G_2$ will not go low, and only one of the flip-flop circuits will be cleared, i.e. that which first receives an input pulse.

Gate $G_3$ detects when there has been a pulse from each of the monostable circuits $M1_A$, $M1_B$ and triggers monostable circuit $M_3$ so as to clock the outputs of gates $G5_A$ and $G5_B$ into the respective shift registers. 10 $\mu$S monostable circuit $M_4$ is triggered so that monostable circuit $M_2$ is fired clearing all four flip-flop circuits in preparation for the next pair of input pulses.

When all the code elements of the key have been read, if the contents of the two shift registers both match the corresponding codes set by code matrices $CM1_A$, $CM1_B$, then gate $G_6$ will turn on f.e.t. $Q_1$ and energise the solenoid.

It will be understood that the above described embodiment is a very simple one in which logic circuits are employed to compare the key code with but a single stored code. Other more sophisticated embodiments, utilizing microprocessors are envisaged in which a number of acceptable codes are stored in the microprocessor memory and the lock is operable if any acceptable code is read.

The electronic circuits, other than the circuit package 50 are housed in a casing 51 housed in an extended mortice hole in the door edge and access to this casing 51 is obtained by removal of a cover plate 52 covering the normal lock housing flange 53 and the extended mortice hole Where the electronics includes a microprocessor, the casing may mount various displays, switches, and sockets, which are used in programming the electronics. The memory which contains the acceptable key codes or other data may be programmed either by inserting a key whilst a switch on the casing is in a programming position or by downloading data from a portable computer into the lock. Preferably the memory is non-volatile, but electrically overwriteable so that key combinations can be changed at will. Many additional functions may be included in a microprocessor program, including lock-out functions (preventing the lock being opened by any key except the one used to lock it), key usage recording.

Figure 12:
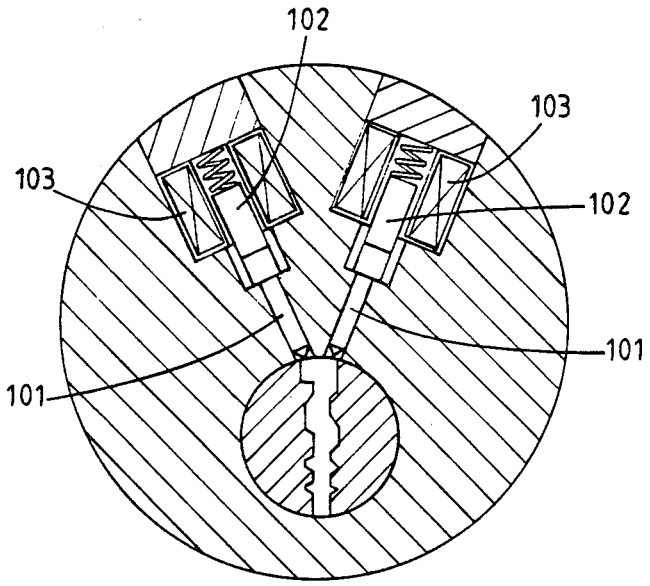
FIG. 12 is a fragmentary sectional view like FIG. 2, but showing another embodiment of the lock.

The alternative key reading devices used in the embodiment shown in FIG. 12 are electromagnetic, rather than piezo-electric. The two probes 101 are formed of non-ferrous metal and are urged into the key slot by spring-loaded magnets 102 slidable inside two coils 103.

The movement of the magnets in the coils caused by the displacement of the probes by the key code elements, causes voltage signals to be induced in the coils. These are amplified and "de-bounced" as in the example described above and applied, as before, to the logic circuit or micro-processor.

We claim:

1. A key for operating an electronically operable lock, said key having a grip portion and an elongate blade portion of a cross-section suitable for reception by the key slot of a conventional mechanical cylinder lock, said blade portion having two opposing edge faces and being notched along one edge face for operation of a conventional cylinder lock, the other edge face of said blade being formed with a relief code pattern therein comprising a plurality of code elements spaced along the blade, each said code element comprising two mechanically readable code portions respectively spaced apart across the width of said other edge of the blade and located relative to one another in one of three possible positional relations, wherein the code portions of some of said code elements are located directly opposite one another, and other code portions of said code elements are spaced longitudinally along the blade relative to one another in one direction and other code portions of said code elements are spaced longitudinally along the blade relative to one another in the opposite direction.

2. A key as claimed in claim 1 in which said code elements comprise grooves across said other edge face of the blade, some of said grooves extending perpendicularly to the length of the blade, others being inclined in one direction to a perpendicular to the length of the blade, and others being inclined in the opposite direction to such perpendicular.

3. A key as claimed in claim 1 in which the two code portions of each code element comprise separate notches at each edge of said edge face

4. An electronic lock for operation by a key as claimed in claim 1, comprising a body, a cylinder rotatably mounted in a bore in the body, said cylinder being formed with a key slot for receiving the key, a pair of mechanically operable reading devices having probes projecting into the key slot so as to be actuable by the code elements on said key as the key is inserted into the key slot, circuit means for determining whether actuation of one of the reading devices by one code portion of each code element occurs before, simultaneously with or after actuation of the other reading device by the other code portion of the same code element and electromechanical means operable by said circuit means on recognition of an acceptable key coding to permit opening of the lock by turning of said cylinder.

5. A lock as claimed in claim 4 in which each of said reading devices comprises a resilient arm which is fixed at one end and has said probe mounted on the other end thereof and a piezo-electric element on said arm for producing an electric output dependent on the degree of bending of said arm.

6. A lock as claimed in claim 5 in which said piezo-electric element comprises a layer of piezo-electric plastics film on the arm, such film being coated on each side with conductive material to provide terminals for the reading device.

7. A lock as claimed in claim 4 in which said electromechanical means comprises a solenoid device which is fixed relative to the lock body and a plunger movable by said solenoid and coacting with a recess in said cylinder to prevent turning of the cylinder except when said solenoid is energised.

8. A lock as claimed in claim 4 in which each of said reading devices comprises a winding, and magnetic means associated with said winding, movement of said probe causing a voltage signal to be induced in said winding.

9. An electronic lock for operation by a key having a relief coding thereon, said lock having a key slot therein for receiving the key, and at least one mechanically operable reading device having a probe projecting into the key slot so as to be movable by the relief coding on the key, a piezo-electric transducer device operable by said probe and electronic circuit means connected to said piezo-electric transducer device so as to receive code signals therefrom, said electronic circuit means operating to enable operation of the lock only on receipt by said circuit means of an acceptable sequence of code signals from said transducer device.

10. An electronic lock as claimed in claim 9 in which said piezo-electric transducer comprises a resilient arm which is fixed to a part of the lock at one end and has said probe mounted on the other end thereof and a piezoelectric element on said arm for producing an electrical output dependent on the degree of bending of said arm.

11. An electronic lock as claimed in claim 10 in which said piezo-electric element comprises a layer of piezo-electric plastics film on the arm, such film being coated on each side with conductive material to provide terminals for the transducer device.

12. An electronic lock as claimed in claim 9 wherein said lock comprises a cylinder body for mounting on a door, a cylinder rotatably mounted in a bore in said cylinder body, said cylinder being formed with said key slot and said cylinder body having said transducer device mounted thereon.

13. An electronic lock as claimed in claim 12 in which said electronic circuit means includes a buffer circuit mounted on said cylinder body adjacent the transducer device and a main circuit spaced from the cylinder body and connected by wiring to said buffer circuit

* * * * *